US007970603B2

(12) United States Patent
Zinser, Jr. et al.

(10) Patent No.: US 7,970,603 B2
(45) Date of Patent: Jun. 28, 2011

(54) METHOD AND APPARATUS FOR MANAGING SPEECH DECODERS IN A COMMUNICATION DEVICE

(75) Inventors: Richard L. Zinser, Jr., Niskayuna, NY (US); Martin W. Egan, Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 894 days.

(21) Appl. No.: 11/940,435

(22) Filed: Nov. 15, 2007

(65) Prior Publication Data

US 2009/0132240 A1 May 21, 2009

(51) Int. Cl.
*G10L 19/00* (2006.01)

(52) U.S. Cl. ..... 704/201

(58) Field of Classification Search ..... 704/201
See application file for complete search history.

(56) References Cited

U.S. PATENT DOCUMENTS

| | | | | |
|---|---|---|---|---|
| 4,937,873 | A | 6/1990 | McAulay et al. | |
| 5,687,095 | A | 11/1997 | Haskell et al. | |
| 6,067,511 | A | 5/2000 | Grabb et al. | |
| 6,073,093 | A | 6/2000 | Zinser, Jr. et al. | |
| 6,078,880 | A | 6/2000 | Zinser, Jr. et al. | |
| 6,081,776 | A | 6/2000 | Grabb et al. | |
| 6,081,777 | A | 6/2000 | Grabb | |
| 6,094,629 | A | 7/2000 | Grabb et al. | |
| 6,098,036 | A | 8/2000 | Zinser, Jr. et al. | |
| 6,119,082 | A | 9/2000 | Zinser, Jr. et al. | |
| 6,138,092 | A | 10/2000 | Zinser, Jr. et al. | |
| 6,678,654 | B2 * | 1/2004 | Zinser et al. | 704/221 |
| 7,062,434 | B2 * | 6/2006 | Zinser et al. | 704/233 |
| 7,165,035 | B2 * | 1/2007 | Zinser et al. | 704/500 |
| 7,272,556 | B1 | 9/2007 | Aguilar et al. | |
| 7,421,388 | B2 * | 9/2008 | Zinser et al. | 704/233 |
| 7,430,507 | B2 * | 9/2008 | Zinser et al. | 704/219 |
| 7,529,662 | B2 * | 5/2009 | Zinser et al. | 704/219 |
| 7,668,713 | B2 * | 2/2010 | Zinser et al. | 704/219 |
| 7,738,361 | B2 * | 6/2010 | Zinser et al. | 370/216 |
| 2005/0102137 | A1 | 5/2005 | Zinser et al. | |
| 2007/0180134 | A1 | 8/2007 | Steinbach et al. | |

OTHER PUBLICATIONS

International Search Report (in connection with related PCT Application No. PCT/US08/83309), dated Jan. 6, 2009.
http://www.globalipsound.com/datasheets/NetEQ.pdf.
ITU-T Recommendation G.729, International Telecommunications Union, Mar. 1996, pp. 31-32. ITU-T Recommendation G.729 Annex D, International Telecommunications Union, Sep. 1998, p. 3.
ITU-T Recommendation G.729 Annex E, International Telecommunications Union, Sep. 1998, pp. 17-18.
ITU-T Recommendation G.711 Appendix I, International Telecommunications Union, Sep. 1999.

* cited by examiner

*Primary Examiner* — Susan McFadden
(74) *Attorney, Agent, or Firm* — Ronald E. Prass, Jr.; Prass LLP

(57) ABSTRACT

A method and apparatus that manages speech decoders in a communication device may include detecting a change in transmission rate from a higher rate to a lower rate, decoding and shifting a first, second and third received first decoder set of frame parameters, generating a first decoder output audio frame from the previously shifted frame parameters, generating a first, second and third second decoder audio fill frame, the second decoder being a higher rate decoder than first decoder, outputting a first and second second decoder audio fill frame, combining the first decoder audio frame and the third second decoder audio fill frame with overlapping triangular windows, and outputting combined first decoder and second decoder frames to an audio buffer for subsequent transmission to a user of the communication device. In an alternative embodiment, another method may include detecting and processing a change in transmission rate from a lower rate to a higher rate.

20 Claims, 5 Drawing Sheets

METHOD AND APPARATUS FOR MANAGING SPEECH DECODERS IN A COMMUNICATION DEVICE

BACKGROUND OF THE DISCLOSURE

1. Field of the Disclosure

The disclosure relates to digital telephone communications.

2. Introduction

In a digital telephonic communication system, it is frequently desirable to be able to rapidly switch between different channel rates in order to control network congestion. Parametric vocoders generally have a much lower rate (and somewhat lower voice quality) than speech-specific waveform coders, so a switch to the lower rate coder is desirable when network congestion is building. Conversely, a switch to the higher rate coder is warranted when the network is lightly loaded. These switches may be initiated quickly at the transmitter, with no advance warning to the receiver.

There are two problems with making a changeover between the coders. (1) The output waveforms of the two coding algorithms will not match. This is true because the waveform-preserving decoder will seek to preserve the actual waveform, while the parametric vocoder decoder will only preserve the salient features gross spectrum, pitch, voicing and signal level). This problem occurs with switches in either direction. (2) The parametric vocoder may require several frames of valid data before it starts to output a signal. This is especially true with TDVC, which has two layers of memory in the decoder (a 3-deep parameter buffer and a 2-frame interpolation buffer). So if an abrupt changeover from the waveform coder to the vocoder occurs, there could be up to three frames of zero-valued (or low-amplitude) output signal before the synthesizer is completely ramped up.

Finally, one other problem may be experienced when changing abruptly to TDVC mode when using some implementation platforms. Due to the interaction of the processor and operating system, some systems will perform arithmetic exception processing when low amplitude signals (e.g. underflow conditions) are processed in the TDVC speech synthesizer. This situation will occur at changeover during TDVC's startup, and must be avoided, since it slows down the processing as much as 5000%.

SUMMARY OF THE DISCLOSURE

A method and apparatus that manages speech decoders in a communication device is disclosed. The method may include detecting a change in transmission rate from a higher rate to a lower rate, clearing a first decoder memory, decoding a first received first decoder set of frame parameters, shifting the first received first decoder frame parameters into a first decoder memory, the first decoder memory being a first-in, first-out (FIFO) memory, decoding a second received first decoder set of frame parameters, shifting the second received first decoder frame parameters into the first decoder memory, decoding a third received first decoder set of frame parameters, shifting the third received first decoder frame parameters into the first decoder memory, generating an output audio frame from the previously shifted frame parameters, saving the audio frame in a temporary buffer, generating a first second decoder audio fill frame, the second decoder being a higher rate decoder than first decoder, outputting the first second decoder audio fill frame to an audio buffer, generating a second decoder audio fill frame, outputting the second decoder audio fill frame to the audio buffer, generating a third second decoder audio fill frame, saving the third second decoder audio fill frame in a temporary buffer, combining the saved first decoder audio frame and the third second decoder audio fill frame with overlapping triangular windows, and outputting combined first decoder and second decoder frames to an audio buffer for subsequent transmission to a user of the communication device.

The method may also include detecting a change in transmission rate from a lower rate to a higher rate, generating a first decoder audio fill frame, saving the generated first decoder audio fill frame in a first decoder memory, clearing a second decoder memory, generating a second decoder audio frame, saving the generated second decoder audio frame in the second decoder memory, combining first decoder and second decoder audio frames with overlapping triangular windows, and outputting the combined first decoder and second decoder frames to an audio buffer for subsequent transmission to a user of the communication device.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION OF THE DISCLOSURE

Figure 1:
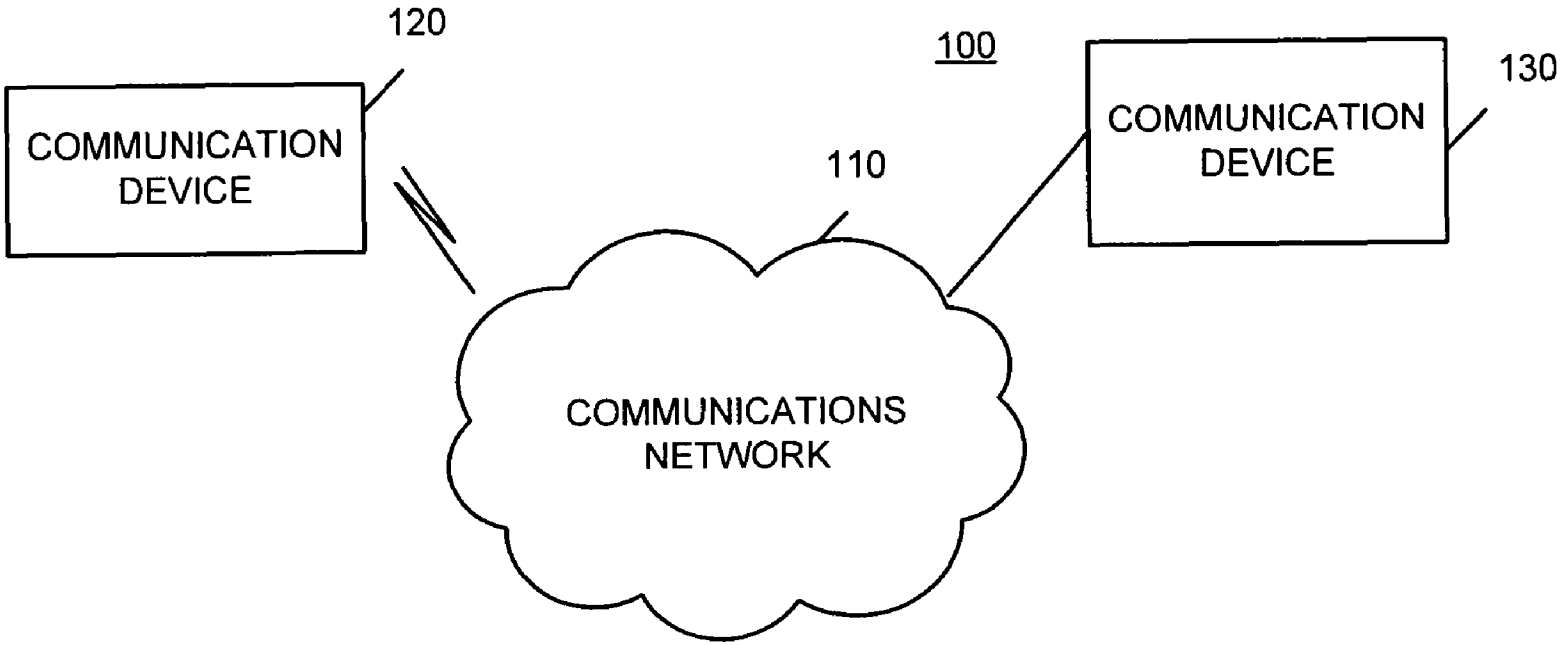
FIG. 1 illustrates an exemplary diagram of a communications network environment in accordance with a possible embodiment of the disclosure.

Additional features and advantages of the disclosure will be set forth in the description which follows, and in part will be obvious from the description, or may be learned by practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth herein.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The disclosure comprises a variety of embodiments, such as a method and apparatus and other embodiments that relate to the basic concepts of the disclosure. This disclosure concerns a method and apparatus for managing decoders in a communication device. The decode management process may utilize two main processing steps: (1) a "boot-up" phase, and (2) a waveform changeover phase. In addition, the process may also require that the waveform coder and the parametric coder must have "fill frame" algorithms. A "fill frame" is normally generated to create synthetic speech in a VoIP environment to replace that actual speech lost when a packet is missing. In one possible embodiment, waveform and parametric coder decoders (such as iLBC and TDVC, respectively) both have fill frame algorithms.

In one possible embodiment, the process may switch from a higher rate waveform coder (such as iLBC) to a lower rate parametric vocoder (such as TDVC). This process may take multiple speech frames to accomplish. For example, the boot-up phase make take all three frames, while the waveform changeover phase may take one frame and may occur simultaneously with the last boot-up frame. During boot-up, when the first new parametric frame, such a TDVC frame for example, is received (after receiving the last waveform frame, such as an iLBC frame, for example), a special TDVC process may be initiated that performs all of the decoding functions except for output speech waveform synthesis. Thus, the new data may be "clocked" into the first frame of the parameter (or TDVC) memory, but the operations that would cause an arithmetic exception may be skipped. To generate the output waveform, the iLBC synthesizer may be utilized with the frame fill flag set to 0 (e.g., a request to generate a fill frame).

These steps may be repeated for the second frame in the sequence. This "clocks" the decoded data into the first and second frames of the TDVC parameter memory, and another iLBC fill frame is used for the output. During the $3^{rd}$ frame, the boot-up sequence may be completed by using the full TDVC decoder (including output waveform synthesis). This process may completely fill the parameter memory, may ramp up the first frame of the interpolation buffer, and may begin to generate an output waveform.

The full TDVC decoder may then be utilized a second time to fill the both frames of the interpolation buffer with the current frame's data, and may generate a complete frame of non-interpolated output waveform. This waveform may be saved in a temporary buffer, for example.

The iLBC decoder may also be utilized during the third frame to generate one more fill frame. This frame may also be saved in a temporary buffer, for example. Both the TDVC and iLBC frames may then be used in the subsequent waveform changeover phase.

During the waveform changeover phase, the iLBC frame may be gradually faded out, while the TDVC frame is simultaneously faded in using overlapped triangular windows.

The transmission rate may also switch from a lower rate to a higher rate. In this manner, the process requires a switch from the vocoder (such as TDVC) to a waveform coder (such as iLBC). This process may take a single frame. The boot-up phase may include, for example:

Clearing the iLBC decoder memory.

Generating a TDVC audio fill frame.

Saving the TDVC output in a temporary buffer.

Running the iLBC decoder to generate an iLBC audio frame from the newly received bits.

Saving the iLBC output in a temporary buffer.

The waveform changeover phase may then be entered, but in this instance, the TDVC frame may be faded out and the iLBC frame may be simultaneously faded in.

FIG. 1 illustrates an exemplary diagram of a communications network environment 100 in accordance with a possible embodiment of the disclosure. The communications network environment 100 may include a plurality of wireless communication devices 120 and a plurality of hardwired (or landline) communication devices 130, connected through a communications network 110.

Communications network 110 may represent any possible communications network that may handle telephonic communications, including wireless telephone networks, hardwired telephone networks, wireless local area networks (WLAN), the Internet, an intranet, etc., for example.

The communication device 120 may represent any wireless communication device capable of telephonic communications, including a portable MP3 player, satellite radio receiver, AM/FM radio receiver, satellite television, portable music player, portable computer, wireless radio, wireless telephone, portable digital video recorder, cellular telephone, mobile telephone, personal digital assistant (PDA), etc., or combinations of the above, for example. Although only one wireless communication device 120 is shown this is merely illustrative. There may be a any number of wireless communication devices 120 in the communications network environment 100.

The communication device 120 may represent any hardwired (or landline) device capable of telephonic communications, including a telephone, server, personal computer, Voice over Internet Protocol (VoIP) telephone, etc., for example. Although only on hard wired communication device 130 is shown this is merely illustrative. There may be a any number of hardwired communication devices 130 in the communications network environment 100.

Figure 2:
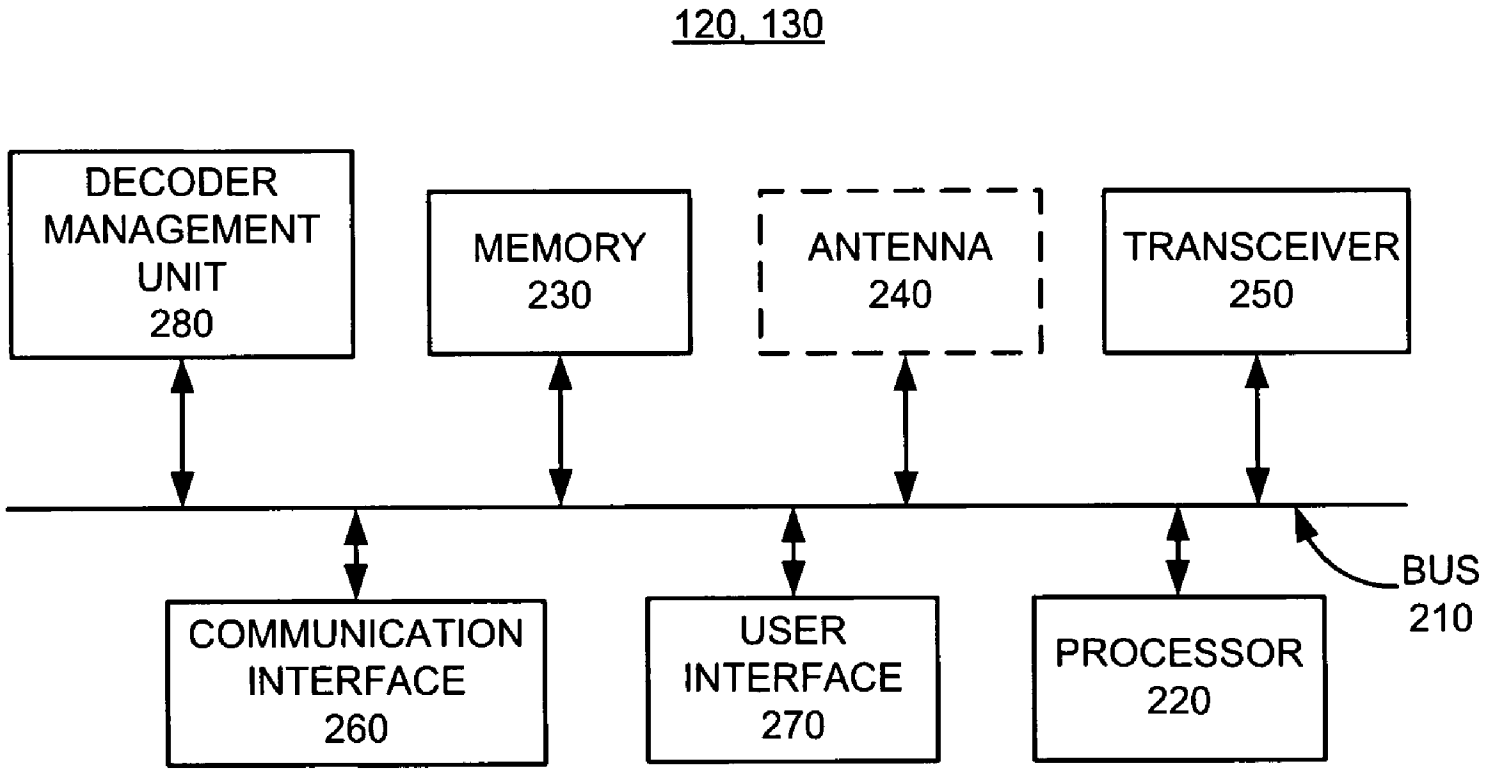
FIG. 2 illustrates a block diagram of an exemplary communication device in accordance with a possible embodiment of the disclosure.

FIG. 2 illustrates a block diagram of an exemplary communication device 120, 130 in accordance with a possible embodiment of the disclosure. The exemplary communication device 120, 130 may include a bus 210, a processor 220, a memory 230, an antenna 240, a transceiver 250, a communication interface 260, a user interface 270, and a decoder management unit 280. Bus 210 may permit communication among the components of the communication device 120, 130.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Transceiver 250 may include one or more transmitters and receivers. The transceiver 250 may include sufficient functionality to interface with any network or communications station and may be defined by hardware or software in any manner known to one of skill in the art. The processor 220 is cooperatively operable with the transceiver 250 to support operations within the communications network 110. In a wireless communication device 120, the transceiver 250 may transmit and receive transmissions via one or more of the antennae 240 in a manner known to those of skill in the art.

Communication interface 260 may include any mechanism that facilitates communication via the network 110. For example, communication interface 260 may include a modem. Alternatively, communication interface 260 may include other mechanisms for assisting the transceiver 250 in communicating with other devices and/or systems via wireless or hardwired connections.

User interface 270 may include one or more conventional input mechanisms that permit a user to input information, communicate with the communication device 120, 130 and/or present information to the user, such as a an electronic display, microphone, touchpad, keypad, keyboard, mouse, pen, stylus, voice recognition device, buttons, one or more speakers, etc.

The communication device 120, 130 may perform such functions in response to processor 220 and/or mobile device location determination unit 280 by executing sequences of instructions contained in a computer-readable medium, such as, for example, memory 230. Such instructions may be read into memory 230 from another computer-readable medium, such as a storage device or from a separate device via communication interface 260.

The operations and functions of the decoder management unit 280 will be discussed in relation to FIGS. 3-5.

Figure 3:
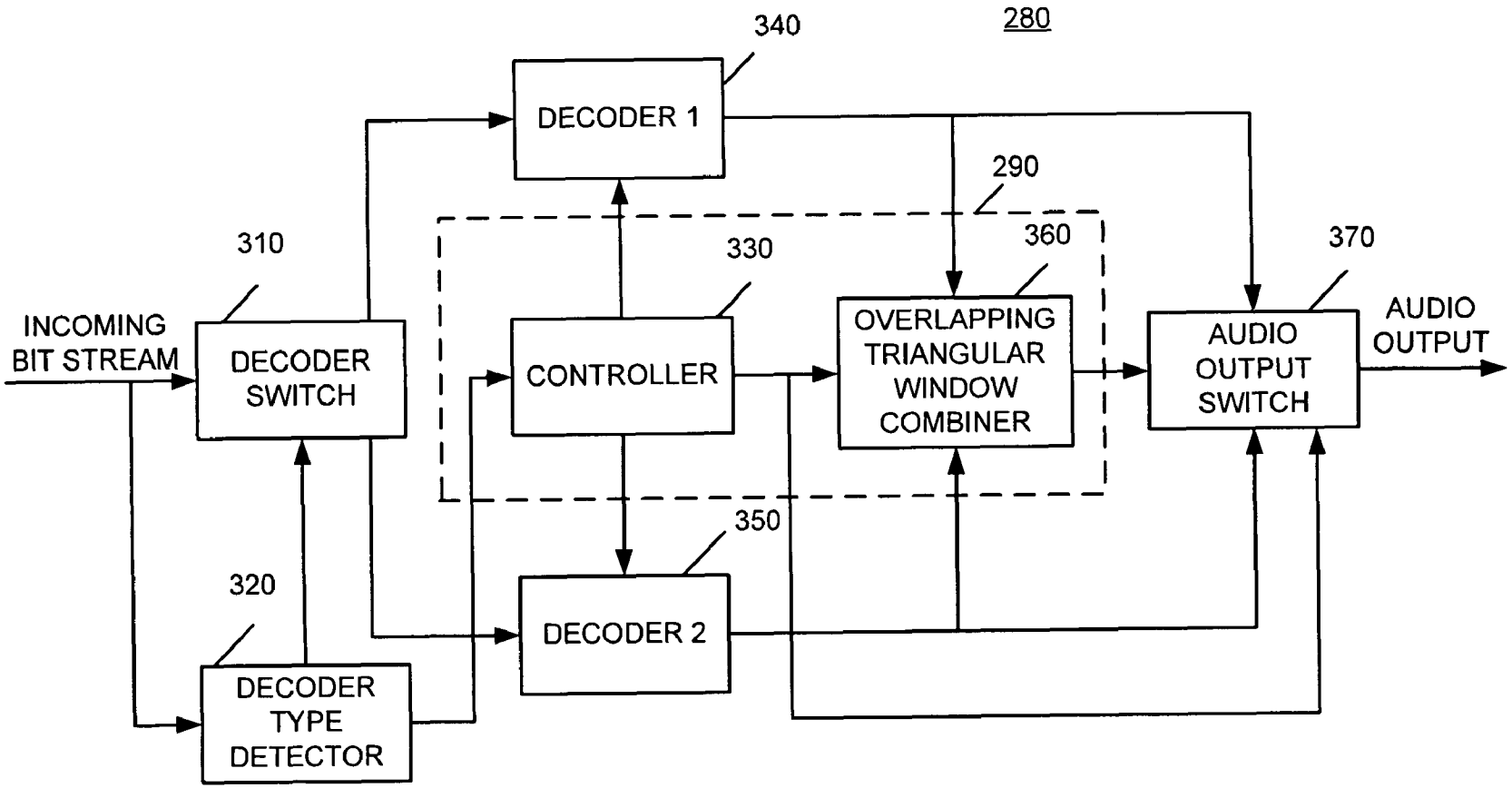
FIG. 3 illustrates an exemplary block diagram of a decoder management unit in accordance with a possible embodiment of the disclosure.

FIG. 3 illustrates an exemplary block diagram of a decoder management unit 280 in accordance with a possible embodiment of the disclosure. The decoder management unit 280 may include decoder switch 310, decoder type detector 320, controller 330, first decoder 340, second decoder 350, an overlapping triangular window combiner 360, and audio output switch 370.

The decoder switch 310 may represent any switching mechanism known to one of skill in the art that may perform the functions of switching between decoders in a communication device 120, 130. In this exemplary embodiment, the decoder switch 310 receives an incoming bit stream. The decoder type detector 320 provides an input to the decoder switch 310 as to which decoder (first decoder 340 or second decoder 350) is required based on the transmission rate of the incoming bit stream. The decoder switch 310 then sends the incoming bit stream to the proper decoder 340, 350 for processing.

The decoder type detector 320 also sends the decoder type requirement input to the controller 330. The controller 330 controls the operations of the decoder management unit 280. In this manner, the controller 330 may receive input from the decoder type detector 320 that the transmission rates have changed. The controller 330 may then control the operation of the decoders 340, 350, an overlapping triangular window combiner 360, and audio output switch 370 in a manner set forth below.

First decoder 340 may represent any decoder having a relatively low channel rate, such as a parametric vocoder. One example of a parametric vocoder is a Time Domain Voicing Cutoff (TDVC) decoder. The first decoder 340 may have its own memory or a memory associated with it, such as a first-in, first-out (FIFO) type memory, or utilize a portion of memory 230.

Second decoder 350 may represent any decoder having a relatively higher channel rate than first decoder 340, such as a waveform coder. One example of a waveform coder is an Internet Low Bit Rate Codec (iLBC) decoder. The second decoder 350 may have its own memory or a memory associated with it, or utilize a portion of memory 230.

The output audio switch 370 may represent any switching mechanism known to one of skill in the art that may perform the functions of switching between decoder outputs in a communication device 120, 130.

For illustrative purposes, the decoder management process and further discussion of the operation of the decoder type detector 310, decoders 340, 350, and the overlapping triangular window combiner 360 will be described below in the discussion of FIGS. 4 and 5 in relation to the diagrams shown in FIGS. 1-3, above.

Figure 4:
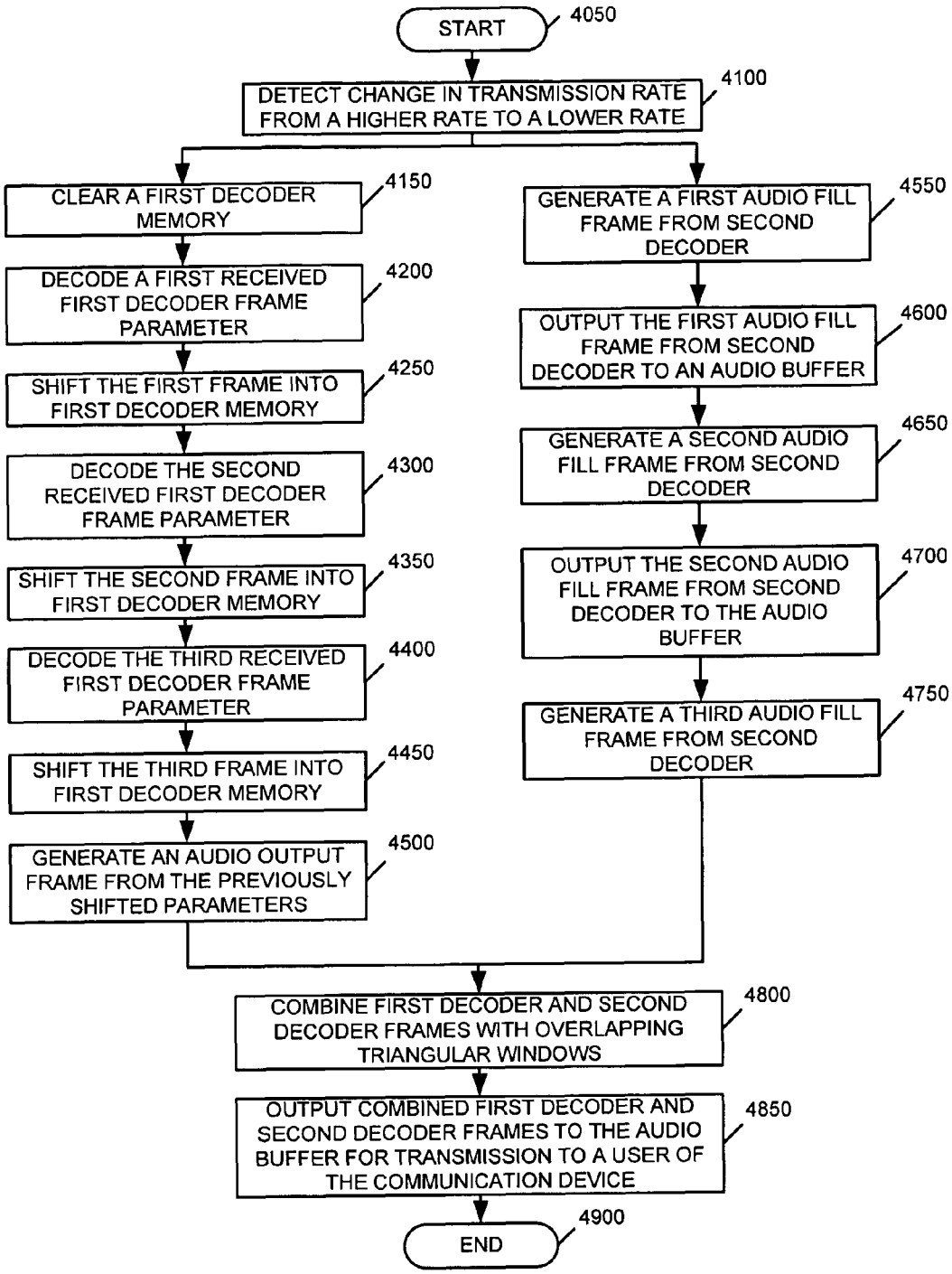
FIG. 4 is an exemplary flowchart illustrating one possible decoder management process in accordance with one possible embodiment of the disclosure.

FIG. 4 is an exemplary flowchart illustrating one possible decoder management process in accordance with one possible embodiment of the disclosure. The process begins at step 4050 and continues to step 4100 where the decoder type detector 320 may detect a change in transmission rate from a higher rate to a lower rate.

At step 4150, the first decoder 340 may clear its memory. At step 4200, the first decoder 340 may decode a first received first decoder set of frame parameters. At step 4250, the first decoder 340 may shift the first received first decoder frame parameters into a first decoder memory. The first decoder memory may be a first-in, first-out (FIFO) memory, for example.

At step 4300, the first decoder 340 may decode a second received first decoder set of frame parameters. At step 4350, the first decoder 340 may shift the second received first decoder frame parameters into the first decoder memory. At step 4400, the first decoder 340 may decode a third received first decoder set of frame parameters. At step 4450, the first decoder 340 may shift the third received first decoder frame parameters into the first decoder memory. At step 4500, the first decoder 340 may generate an output audio frame from the previously shifted parameter frames, and save the audio frame in a temporary buffer.

At step 4550, the second decoder 350 may generate a first second decoder audio fill frame. As discussed above, the second decoder 350 is a higher rate decoder than first decoder 340. At step 4600, the second decoder 350 may output the first second decoder audio fill frame to an audio buffer.

At step 4650, the second decoder 350 may generate a second decoder audio fill frame. At step 4700, the second decoder 350 may output the second decoder audio fill frame to the audio buffer. At step 4750, the second decoder 350 may generate a third second decoder audio fill frame, and save the audio frame in a temporary buffer.

At step 4800, the overlapping triangular window combiner 360 may combine the saved first decoder audio frame and the third second decoder audio fill frame with overlapping triangular windows. This step may utilize the following equation:

$$y(i)=w(i)x_{TDVC}(i)+(1-w(i))x_{iLBC}(i),0\leqq i<N$$

where y(i) is the output waveform, $x_{TDVC}(i)$ is the TDVC-generated waveform, $x_{iLBC}(i)$ is the iLBC-generated waveform, N is the frame length, and w(i) is the triangular window $$w(i)=\frac{i}{N}.$$

At step 4850, the overlapping triangular window combiner 360 may output the combined first decoder and second decoder frames to an audio buffer for subsequent transmission to a user of the communication device 120, 130. The process then goes to step 4900, and ends.

Figure 5:
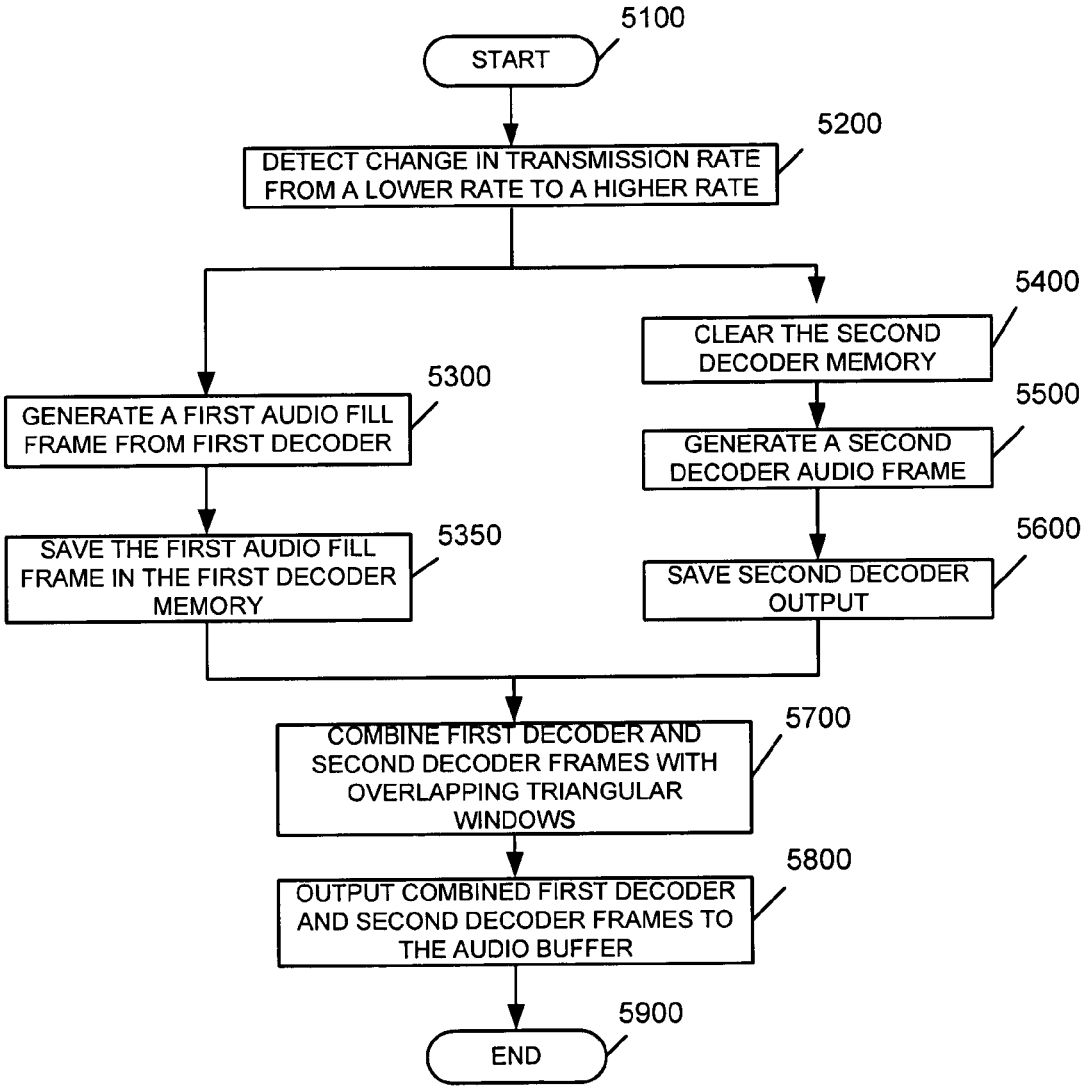
FIG. 5 is an exemplary flowchart illustrating another possible decoder management process in accordance with one possible embodiment of the disclosure.

FIG. 5 is an exemplary flowchart illustrating another possible decoder management process in accordance with one possible embodiment of the disclosure. The process begins at step 5100 and continues to step 5200 where the decoder type detector 320 may detect a change in transmission rate from a lower rate to a higher rate. At step 5300, the first decoder 340 may generate a first decoder audio fill frame.

At step 5350, the first decoder 340 may save the generated first decoder audio fill frame in a first decoder memory. At step 5400, the second decoder 350 may clear the second decoder memory. At step 5500, the second decoder 350 may generate a second decoder audio frame. At step 5600, the second decoder 350 may save the generated second decoder audio frame in the second decoder memory.

At step 5700, the overlapping triangular window combiner 360 may combine first decoder and second decoder audio frames with overlapping triangular windows. In this manner, the process may use the following equation:

$$y(i)=w(i)x_{iLBC}(i)+(1-w(i))x_{TDVC}(i),0\leqq i<N$$

where y(i) is the output waveform, $x_{TDVC}(i)$ is the TDVC-generated waveform, $x_{iLBC}(i)$ is the iLBC-generated waveform, N is the frame length, and w(i) is the triangular window $$w(i)=\frac{i}{N}.$$

At step 5800, the overlapping triangular window combiner 360 may combine the first decoder and second decoder frames for output to an audio buffer for subsequent transmission to a user of the communication device 120, 130. The process then goes to step 5900, and ends.

Embodiments within the scope of the present disclosure may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Although the above description may contain specific details, they should not be construed as limiting the claims in any way. Other configurations of the described embodiments of the disclosure are part of the scope of this disclosure. For example, the principles of the disclosure may be applied to each individual user where each user may individually deploy such a system. This enables each user to utilize the benefits of the disclosure even if any one of the large number of possible applications do not need the functionality described herein. In other words, there may be multiple instances of the decoder management unit 280 or it components in FIGS. 2-5 each processing the content in various possible ways. It does not necessarily need to be one system used by all end users. Accordingly, the appended claims and their legal equivalents should only define the disclosure, rather than any specific examples given.

We claim:

1. A computer-implemented method for managing speech decoders in a communication device, comprising:

detecting a change in transmission rate from a higher rate to a lower rate;

clearing a first decoder memory;

decoding a first received first decoder set of frame parameters;

shifting the first received first decoder frame parameters into a first decoder memory, the first decoder memory being a first-in, first-out (FIFO) memory;

decoding a second received first decoder set of frame parameters;

shifting the second received first decoder frame parameters into the first decoder memory;

decoding a third received first decoder set of frame parameters;

shifting the third received first decoder frame parameters into the first decoder memory;

generating a first decoder audio frame from the previously shifted frame parameters;

saving the first decoder audio frame in a temporary buffer;

generating a first second decoder audio fill frame, the second decoder being a higher rate decoder than first decoder;

outputting the first second decoder audio fill frame to an audio buffer;

generating a second decoder audio fill frame;

outputting the second decoder audio fill frame to the audio buffer;

generating a third second decoder audio fill frame;

saving the third decoder audio fill frame to a temporary buffer;

combining the saved first decoder audio frame and the third second decoder audio fill frame with overlapping triangular windows; and outputting the combined first decoder and second decoder frames to the audio buffer for subsequent transmission to a user of the communication device.

2. The computer-implemented method of claim 1, wherein the first decoder is a Time Domain Voicing Cutoff (TDVC) decoder.

3. The computer-implemented method of claim 1, wherein the second decoder is an Internet Low Bit Rate Codec decoder.

4. The computer-implemented method of claim 1, wherein the overlapped triangular windows are combined using the equation $y(i)=w(i)x_{TDVC}(i)+(1-w(i))x_{iLBC}(i), 0 \leqq i < N$, where $y(i)$ is the output waveform, $x_{TDVC}(i)$ is the a first decoder-generated waveform, $x_{iLBC}(i)$ is a second decoder-generated waveform, N is the frame length, and $w(i)$ is the triangular window $$w(i) = \frac{i}{N}.$$

5. The computer-implemented method of claim 1, wherein the communication device may be a portable a satellite radio transceiver, a Voice over Internet Protocol (VoIP) phone, portable computer, wireless telephone, cellular telephone, mobile telephone, personal digital assistant (PDA), and hard wired telephone.

6. A decoder management unit that manages speech decoders in a communication device, comprising:

a decoder type detector that detects a change in transmission rate from a higher rate to a lower rate;

a first decoder that clears a first decoder memory, the first decoder memory being a first-in, first-out (FIFO) memory, decodes a first received first decoder set of frame parameters, shifts the first received first decoder frame parameters into a first decoder memory, decodes a second received first decoder set of frame parameters, shifts the second received first decoder frame parameters into the first decoder memory, decodes a third received first decoder set of frame parameters, shifts the third received first decoder frame parameters into the first decoder memory, generates a first decoder audio frame from the previously shifted frame parameters, and saves the first decoder audio frame in a temporary buffer;

a second decoder being a higher rate decoder than first decoder that generates a first second decoder audio fill frame, outputs the first second decoder audio fill frame to an audio buffer, generates a second decoder audio fill frame, outputs the second decoder audio fill frame to the audio buffer, and generates a third second decoder audio fill frame;

an overlapping triangular window combiner that combines the saved first decoder frame and the third second decoder audio fill frame with overlapping triangular windows, and outputs the combined first decoder and second decoder frames the audio buffer for subsequent transmission to a user of the communication device.

7. The decoder management unit of claim 6, wherein the first decoder is a Time Domain Voicing Cutoff (TDVC) decoder.

8. The decoder management unit of claim 6, wherein the second decoder is an Internet Low Bit Rate Codec decoder.

9. The decoder management unit of claim 6, wherein the overlapping triangular window combiner combines the overlapped triangular windows using the equation $y(i)=w(i)x_{TDVC}(i)+(1-w(i))x_{iLBC}(i)$ $0\leqq i<N$, where y(i) is the output waveform, $x_{TDVC}(i)$ is the a first decoder-generated waveform, $x_{iLBC}(i)$ is a second decoder-generated waveform, N is the frame length, and w(i) is the triangular window $$w(i) = \frac{i}{N}.$$

10. The decoder management unit of claim 6, wherein the communication device may be a portable a satellite radio transceiver, a Voice over Internet Protocol (VoIP) phone, portable computer, wireless telephone, cellular telephone, mobile telephone, personal digital assistant (PDA), and hard wired telephone.

11. A computer-implemented method for managing speech decoders in a communication device, comprising:

detecting a change in transmission rate from a lower rate to a higher rate;

generating a first decoder audio fill frame;

saving the generated first decoder audio fill frame in a first decoder memory;

clearing a second decoder memory;

generating a second decoder audio frame;

saving the generated second decoder audio frame in the second decoder memory;

combining first decoder and second decoder audio frames with overlapping triangular windows; and outputting the combined first decoder and second decoder frames to an audio buffer for subsequent transmission to a user of the communication device.

12. The computer-implemented method of claim 11, wherein the first decoder is a Time Domain Voicing Cutoff (TDVC) decoder.

13. The computer-implemented method of claim 11, wherein the second decoder is an Internet Low Bit Rate Codec decoder.

14. The computer-implemented method of claim 11, wherein the overlapped triangular windows are combined using the equation $y(i)=w(i)x_{iLBC}+(1-w(i)x_{TDVC}(i)$, $0\leqq i<N$, where y(i) is the output waveform, $x_{TDVC}(i)$ is the a first decoder-generated waveform, $x_{iLBC}(i)$ is a second decoder-generated waveform, N is the frame length, and w(i) is the triangular window $$w(i) = \frac{i}{N}.$$

15. The computer-implemented method of claim 11, wherein the communication device may be a portable a satellite radio transceiver, a Voice over Internet Protocol (VoIP) phone, portable computer, wireless telephone, cellular telephone, mobile telephone, personal digital assistant (PDA), and hard wired telephone.

16. A decoder management unit that manages speech decoders in a communication device, comprising:

a decoder type detector that detects a change in transmission rate from a lower rate to a higher rate;

a first decoder that generates a first audio fill frame;

a second decoder that generates a second decoder audio frame, and saves second decoder output in a second decoder memory; and an overlapping triangular window combiner that combines the first decoder and second decoder audio frames with overlapping triangular windows, and outputs the combined first decoder and second decoder frames to an audio buffer for subsequent transmission to a user of the communication device.

17. The decoder management unit of claim 16, wherein the first decoder is a Time Domain Voicing Cutoff (TDVC) decoder.

18. The decoder management unit of claim 16, wherein the second decoder is an Internet Low Bit Rate Codec decoder.

19. The decoder management unit of claim 16, wherein the overlapping triangular window combiner combines the overlapped triangular windows using the equation $y(i)=w(i)x_{iLBC}(i)+(1-w(i))x_{TDVC}(i)$ $0\leqq i<N$, where y(i) is the output waveform, $x_{TDVC}(i)$ is the a first decoder-generated waveform, $x_{iLBC}(i)$ is a second decoder-generated waveform, N is the frame length, and w(i) is the triangular window $$w(i) = \frac{i}{N}.$$

20. The decoder management unit of claim 16, wherein the communication device may be a portable a satellite radio transceiver, a Voice over Internet Protocol (VoIP) phone, portable computer, wireless telephone, cellular telephone, mobile telephone, personal digital assistant (PDA), and hard wired telephone.

* * * * *